US012343654B2

(12) United States Patent
Maslik

(10) Patent No.: US 12,343,654 B2
(45) Date of Patent: Jul. 1, 2025

(54) BUILDING TOY SYSTEM WITH BASIC ELEMENT AND CONNECTING PIN

(71) Applicant: Lubomir Maslik, Pezinok (SK)

(72) Inventor: Lubomir Maslik, Pezinok (SK)

( * ) Notice: Subject to any disclaimer, the term of this patent is extended or adjusted under 35 U.S.C. 154(b) by 345 days.

(21) Appl. No.: 17/904,990

(22) PCT Filed: Feb. 25, 2021

(86) PCT No.: PCT/IB2021/051572
§ 371 (c)(1),
(2) Date: Aug. 25, 2022

(87) PCT Pub. No.: WO2021/171214
PCT Pub. Date: Sep. 2, 2021

(65) Prior Publication Data

US 2023/0135788 A1 May 4, 2023

(30) Foreign Application Priority Data

Feb. 27, 2020 (SK) ..... 50018-2020

(51) Int. Cl.
*A63H 33/10* (2006.01)

(52) U.S. Cl.
CPC ..... *A63H 33/107* (2013.01); *A63H 33/101* (2013.01)

(58) Field of Classification Search
CPC ... A63H 33/107; A63H 33/101; A63H 33/108
USPC ..... 273/123, 144, 153 R, 156, 160
See application file for complete search history.

(56) References Cited

U.S. PATENT DOCUMENTS 3,165,750 A * 1/1965 Tell ..... H01Q 15/10 343/753
3,685,201 A 8/1972 Hieronimus
3,987,579 A * 10/1976 Palenik, III ..... A63H 33/108 446/124
4,182,072 A 1/1980 Much
4,283,055 A * 8/1981 Larsen ..... A63F 9/12 273/160

(Continued)

FOREIGN PATENT DOCUMENTS

CZ 46 2/1993
DE 1478415 6/1969

(Continued)

*Primary Examiner* — Nini F Legesse
(74) *Attorney, Agent, or Firm* — Defillo & Associates, Inc; Evelyn A. Defillo

(57) ABSTRACT

The building toy includes at least one basic element and at least one connecting pin. The basic element has a body where in the wall there is at least one connecting opening led perpendicularly onto the wall. The connecting opening runs through the body of the basic element as a transitory cavity and the connecting opening is designed for an insertion of the connecting pin. All connecting openings in the body are mutually spatially skew. The pairs of connecting openings from each wall run through the body to lie in mutually perpendicular and rotated planes and the distance of the connecting openings if each pair is identical and it is at least the length of a diameter of the connecting openings. The pairs in the central zone of the body avoid each other without the cavities of the connecting openings colliding mutually.

20 Claims, 8 Drawing Sheets

(56) References Cited

U.S. PATENT DOCUMENTS

| | | | | | |
|---|---|---|---|---|---|
| 4,547,160 | A * | 10/1985 | Labelle | G09B 1/40 446/107 |
| 4,620,747 | A | 11/1986 | Lemmon | |
| 5,152,530 | A * | 10/1992 | Dodek, II | A63F 9/12 273/156 |
| 6,460,850 | B1 * | 10/2002 | Dodek, II | A63F 9/12 273/156 |
| 2018/0133614 | A1 | 5/2018 | Kendall | |

FOREIGN PATENT DOCUMENTS

| | | |
|---|---|---|
| DE | 2242046 | 2/1974 |
| DE | 3142969 | 6/1982 |
| EP | 0498368 | 8/1992 |
| EP | 0911070 | 4/1999 |
| EP | 3135360 | 3/2017 |
| FR | 2405730 | 5/1979 |
| GB | 773652 | 5/1957 |
| GB | 2108857 | 5/1983 |
| GB | 2393136 | 3/2004 |
| SK | 2088 | 10/1998 |
| WO | WO9221417 | 12/1992 |

* cited by examiner

BUILDING TOY SYSTEM WITH BASIC ELEMENT AND CONNECTING PIN

CROSS REFERENCE TO RELATED APPLICATION

This application is a national stage entry of PCT/IB2021/051572 filed Feb. 25, 2021, under the International Convention and claiming priority over Slovakia Patent Application No. SK PUV 50018-2020 filed Feb. 27, 2020.

FIELD OF TECHNOLOGY

The invention concerns a building toy which involves a basic element with connecting openings into which a connecting pin, designed for a connection of an element or a block with a neighboring element or a block, is inserted, whereby the basic element allows for connection of the elements or blocks in all three dimensions. Aside from the basic element, the building toy also contains multiple elements, derived elements and combined elements.

PRIOR STATE OF THE ART

Building toys are important for the development of various capabilities of the children; they develop the creativity, spatial imagination, fine motor skills and other skills. The size of the basic blocks as well as difficulty of construction differs pursuant to the particular age of a user.

A system of the connection of the blocks by means of protrusions is known and commercially widespread, where on the one side of the block there are protrusions and on the opposite side of another block there are cavities into which the protrusions fall. Such solution, pursuant to DE2242046A1, is simple to use, but it only allows one to build the construction in a single direction—in the direction where the protrusions are oriented—which limits the possibilities of construction and creativity.

Document pursuant to publication EP0498368A2 discloses a building block with blind openings in the middle of each side, whereby pins with a square cross-section are inserted to the openings. This arrangement allows one to produce a rotationally fixed connection of the building blocks, but the possibilities of connection are limited since the pint can be only inserted between the blocks when the blocks are in distant position; the pin cannot be inserted between the sides of the block in an already adjacent position. Similar position of the connecting pins is also in a solution according to EP3135360A1 where the openings are not blind, but they have a stop for the position of the pin, which defines the maximum depth of its insertion. This deficiency is partially remedied by solutions such as EP0911070A2, GB773652A, US2018133614A1, where the building block has transitory openings for the connecting pins.

Publications U.S. Pat. Nos. 3,854,237A, 4,182,072A, 4,547,160, 3,685,201A, SK2088U, CZ46U disclose building elements, mainly in shape of a cube or a block, where the building element has transitory openings designed for the insertion of the connecting pin. The connecting pin is independent and runs through the openings in at least two neighboring elements. Similar principle is used in publication EP2656890A1 which discloses multiple building elements. The disadvantage of these solutions is that after the pin is inserted through the middle of the building element the openings from the other directions become blind, intransitory, which negates the advantage of a universal connective possibility.

Some technical solutions such as those pursuant to DE3142969A1, WO9221417A1, GB2108857A contain larger building blocks, such as multiple blocks or bricks derived from the basic shape which have some skew openings, but not all openings of a single block are mutually skew and the arrangement of the openings does not allow for any orientation of connection, or the neighboring blocks cannot be aligned, justified by their edges.

Such new technical solution is desired which will be constructionally simple, will allow to build a buildings toy into the spatial system in all three directions, whereby the surface of the building element should be without protrusions damaging the profile of the resulting piece. In this new technical solution, the building elements shall be connected by means of connecting pins in such a way that the connecting elements run freely through multiple building elements in any direction.

SUMMARY OF THE INVENTION

Abovementioned deficiencies are significantly remedied by a building toy which includes at least one building element and at least one independent connecting pin where the basic element has a body whose at least three neighboring outer sides (walls) are mutually perpendicular and in each such side (wall) there is at least one transitory connecting element led perpendicularly onto the wall of the side, whereby the connecting element is designed for an insertion of the connecting pin which is designed for a connection of the basic element with the neighboring element of the building toy, according to this invention, which essence lies in the fact that all connecting elements in the body are mutually spatially skew. The connecting openings are spatially skew in such a way that not only their axes are skew, but the whole profile of each connecting opening is independent and does not intersect with the profile of another connecting opening. The connecting openings are placed on each front surface in such a way that no connecting pin interferes with other openings or cannot form an obstacle to insertion of another pin from any direction. The cavity of each connecting opening reaches from one side (wall) of the basic element to the opposite side (wall); preferably it forms an uninterrupted, independent tunnel designed for guidance and presence of the connecting pin.

The skewness (or offset) of the connecting openings has a significant advantage in the fact that the connecting pins can run through the body of the basic element independently and from various dimensions without limiting each other. That means that the connecting pins, if they are inserted in a single basic element from all three directions, do not mutually collide. A criterion follows that the connecting openings in a body of a single basic element cannot all run through the centre of the body. If one of the connecting openings runs through the centre of the body, other connecting openings must run outside the centre of the body. The final feature which differs in comparison with the prior art is that all connecting openings of the basic element are skew so that not even on the basic elements (that is, the small block) a situation occurs that the connecting pin enters into the spatial collision with the connecting pin led in another direction. It is, however, preferable if the connecting openings on each mutually perpendicular side are placed symmetrically on such a side, so that the basic element can be used in various positions.

This conflict between the demands for spatial skewness of all connecting openings and the need for symmetrical arrangement of the connecting openings within each wall of a side can be preferably solved by an arrangement where on the first side (wall) of the basic element there is a first pair of the connecting openings with an identical diameter, both connecting elements of the first pair are mutually distant from each other at least at the distance of the diameter of the connecting opening, whereby axes of both connecting openings of the first pair lie in the first plane which is perpendicular to the first side (wall) and runs through the middle of the first side (wall). The distance of the connecting openings means the distance of the adjacent edges of the connecting openings, that is, it defines the size of the gap between theme, whereby in another direction a plane with further pair of the connecting openings can run through this gap. At the same time the middle of the connecting line of the connecting openings on the first side (wall) is in the middle of the first side (wall).

This distribution of the connecting openings produces a symmetricity of the placement of the pair against the middle of the side (wall), but at the same time the cavities of the connecting openings do not run through the middle of the body and leave a free space, whose width is at least the same as the diameter of the connecting openings, in the middle zone. Thanks to this a second pair of the connecting openings with the axes in the second plane, whereby these connecting openings have an identical arrangement as the first pair in the first side (wall); however, these second openings are rotated in such a way that the second plane is perpendicular onto the first plane and at the same time the second plane intersects the first plane in a line which is a symmetry axis of the first pair of the connecting openings.

In this mutual spatial relationship between the first and second pair of the connecting openings the cavities of all four connecting openings are skew and at the same time the connecting openings within a single pair are parallel and, at the same time, symmetrically placed within a single side (wall). The cavity of neither connecting opening runs through the centre of the body and the spatial rotation of the second pair against the first pair allows for the placement of the third pair of the connecting openings with axes in the third plane on the third side (wall) of the basic element, whereby in the third side (wall) these connecting openings have a same arrangement as is the case for the first and second pair on the first and second side (wall), but the connecting openings that form the third pair are rotated in the space in such a way that the third plane is perpendicular onto the first plane and, at the same time, onto the second plane and, at the same time, the third plane intersects the second plane in the line which is a symmetry axis of the second pair of the connecting openings. The first, second and third plane are mutually perpendicular and all intersect in the centre of the body. The position and distance of the connecting elements within a respective side (wall) is identical as is the case in the remaining two sides (walls) which allows one to use the basic element in any position and, at the same time, to use the cavities of all six connecting openings without their mutual intersection. Thanks to this the independently led connecting pins can run through these connecting openings and these can gradually run through multiple elements of the building toy.

The defined spatial relationship between three pairs of the connecting openings of the basic element offers a possibility of symmetric use of the basic element in any position and in any direction, whereby it excellently uses an inner space of the body of the basic element for the guidance of the six connecting openings which, even though they run through the whole body of the basic element, do not mutually intersect each other and therefore the inner surface of the connecting openings do not interfere with each other.

In the preferable arrangement the basic element has a body with an outer shape of a cube. In such case the basic element has six cavities which run in first, second and third mutually perpendicular plane, whereby each cavity runs from one side (wall) of the cube to the opposite side (wall) of the cube; all connecting openings are identical. It is preferable if the building toy contains multiple basic elements in shape of a cube.

The basic element can have dimensions in order of millimeters. The miniaturization of the basic element is limited by the minimal practical dimensions of the connecting pin in such a way that it can be worked with by bare fingers without tools. The dimension of the wall of the basic element in form of a brick can be from 10 to 50 mm, but it can be in order of decimeters, too, for example for the purposes of exterior construction.

With a certain simplification one can produce construction in any shape from the basic cube-shaped elements. The construction from the identical cubes or bricks is interesting from the point of view of the user pursuant to the widespread 3D sandbox games where a player moves freely in the virtual world composed of bricks. However, it is also preferable if the building toy includes multiple and/or derived and/or combined element, whereby these elements are always compatible with the basic element of the building toy.

The multiple elements is made by merging the two or more basic elements into a single body. For example, merging of two cube-shaped basic elements results in the multiple elements in a shape of a block whose one side is twice the side of the basic element. The merger of basic elements produces multiple elements in such a way that the connecting openings on the longer side are placed in the same raster as in the case of a basic element and all connecting elements are still transitory. The multiple elements can include various number of basic elements, usually two, three or even tens of these elements. The multiple elements can be a merger of multiple basic elements which are placed in varying angular or shape combination—for example, in shape of a letter L or U, and so on.

Derived element is formed from the basic or multiple elements in such a way that the body of the derived element is a section or a cut of the basic or multiple elements. The surfaces of the dissection or multiple surfaces of the dissection cut through the original body of the basic or multiple elements and the surface of the dissection can be defined by a plane or by a cylindrical surface or by a spatial curve, whereby it is preferable if at least one side of the original basic element or multiple elements remains solid and undivided, without the intersection with the surface of dissection. The position of the connecting openings in the derived element remains the same as it was before the "cutting" of the basic element or the multiple elements. The derived element can have a shape of a spire, wedge or pyramid, a shape of a narrowing block, and so on. The derived element can have a rounded cut out, an arc, and so on. It is preferable if at least parts of three mutually perpendicular walls forming a single corner are maintained within a derived element, which allows for a connection of the derived element in three directions.

The connecting pin has a diameter which corresponds to the diameter of the connecting openings with a certain gap so that the connecting pin can be inserted into the connecting opening manually without undue exertion. It is preferable if the connecting pin and the connecting opening has a mutually corresponding flexible click-in stops or some other, similarly mechanically functioning elements which ensure that the connecting pin will fall in in the correction position and will be kept (locked) in this position by a joint of the pre-determined firmness. The falling in of the click-in stop into a groove blocks the position of the connecting pin in the cavity of the connecting opening, whereby a force is needed to overcome this connection (joint), whereby the size of the force can be adjusted by the construction of the pair stop/groove, that is, mainly by means of selection of the dimensions and materials. The size of the de-blocking force needed for the release of the connecting pin will be set pursuant to the age of the users for whom the building toy is designed, or pursuant to the purpose of the building toy since the building toy pursuant to this invention can be used for building of more stable constructions, for example, for the purposes of presentation or exhibition, and so on.

The connecting pin has a length which is sufficient to connect at its ends at least two basic elements. It is preferable if the connecting pin has a length that is identical as is the dimension of the side of the basic cube-shaped element or if the connecting pin has a length that is a whole number multiple of the dimension of the side of the basic cube-shaped element.

In one realization the cavities of the connecting openings have circumferential grooves into which a flexible protrusion from the connecting pin falls. In another realization the circumferential groove can be placed on the connecting pin and flexible protrusions are place on the side of the connecting openings. A connecting pin can be produced from flexible plastics, from wood, and so on.

The end of the connecting pin can branch into two or three segments, whereby a gap is between these segments, so that flexible stops are produced on both ends of the connecting pin even when the diameter of the connecting pin is small. An outside oriented protrusion is on the segments, whereby this protrusion is designed for falling into circumferential groove of the connecting opening. When the protrusion runs through the cavity of the connecting opening outside of the circumferential groove, it is pressed by the surface of the cavity whereby the segments on both ends of the connecting pin are pressed together. The gap between the segments of the connecting pin should have a dimension corresponding at least to the diameter of the circumferential groove and the diameter of the cavity of the connecting opening. The tip of the segment can be rounded or sloped into a cone so that the insertion of the end of the connecting pin to the connecting opening is easy.

It is preferable if there are multiple circumferential grooves in the cavity of the connecting opening. In case of the basic cube-shaped element there are four evenly distanced circumferential grooves in the cavity of the connecting opening, whereby the circumferential grooves by the edge of the cavity are distanced from the edge in the ⅛ of the length of the cavity. That means that the first circumferential groove is in the % of the length of the cavity, the second is in ⅛+¼ of the length of the cavity, the third is in ⅛+¼+¼ of the length of the cavity, and the fourth is in the ⅛+¼+¼+¼ of the length of the cavity, that is in the ⅛ of the length of the cavity from the other side. In such position the circumferential grooves are placed symmetrically and the connecting pin with the length identical to the dimension of the side of the basic element has protrusions in the distance that is ⅛ from the edge. The connecting pin can hold two neighboring basic elements in such a way that it is inserted in varying depth of the cavity of the connecting element.

Aside from the basic length of the connecting pin the building toy can also include a multiple connecting pin or a shortened connecting pin with ¾ or ½ of the length of the basic connecting pin. The shortened connecting pin that is half the length of the basic connecting pin can be used as a blinding connecting pin with flexible segments with protrusions only on one end. Such a blinding pin will be preferably used to blind the connecting opening from the view side or to connect shortened cavities of the derived elements where the cut plane shortened the length of the cavity of the connecting opening. A connecting opening at length of ¾ of the length of the basic connecting pin can be used preferably in such cases. The connecting pins or blinding pins can have a front or a whole body produced in the color of the basic, derived and combined elements. In such case the pins will be visually hidden in the overall appearance of the finished construction. In another arrangement can these pins or at least their fronts produced in different—for example, contrastive—color than the color of the basic, derived and combined elements. The different color is then assessed when planning the overall visual effect of the finished construction.

A detailed realization of the connecting openings and the connecting pins will be chosen pursuant to the size of the constructional building elements and the used material. The building elements can be produced from the solid material such as wood, plastics or glass. The building elements, especially the larger ones, will be preferably produced from plastics in such a way that the material does not fill in the whole inside of the body of the building element. In case of large dimensions of the building elements, for example, in case of the exterior building toys, the building element can be produced from flat plates which have connecting openings and the cavities of the connecting openings delimited by pipes inserted inside the body of the building element.

Since after the insertion of the connecting pin to the cavity in the body of the building element the connecting pin does not protrude outside, it is preferable if the building toy includes a tool which has a spike for pushing the connecting pin out. The diameter of the spike is equal or less than the diameter of the connecting opening and the length of the spike is half or at least equal or larger than the elements used in the building toy. The connecting pin or multiple connecting pins are pushed out by pushing of the spike into the connecting opening. The spike can be connected with a handle for easier manipulation. It is also preferable if the tool has two spikes which are parallel and at such a distance from each other (pitch) as is the pair of connecting openings on the side of the basic element. With such an arrangement the connecting pins are pushed out in two lines by a single movement.

A tool has proved especially comfortable during assembly and subsequent disassembly which has two spikes on the side of a handle, whereby the length of the spikes is half the dimension of the side of the basic cube-shaped element and on the second side of the handle there are two spikes with the length that is equal to the dimension of the side of the basic cube-shaped element.

An advantage of the proposed invention is the simple creation of the spatial structures of different shapes with high solidity and firmness, whereby the construction is intuitive and the direction of the connection of the neighboring elements is free to choose. A significant advantage of the building toy according to this invention lies in the mutual position of the connecting elements, thanks to which the connecting pins can be inserted in all directions without the collision with the connecting elements from another direction. The surface of the construed work is smooth and without protrusions which in other building systems form a mean of connection. The smooth surface corresponds better to the desired visual of the construction.

DESCRIPTION OF DRAWINGS

The invention is further disclosed by means of FIGS. 1 to 33. The depicted scale of individual elements and the shape of assembled constructions are examples only and cannot be interpreted as features limiting the scope of protection. Position 1 in FIGS. 12, 14, 16, 18 and 25 depicts a supposed basic element as if it were used for production of the derived or multiple elements. Position 8 denotes the same in FIG. 20.

EXAMPLES OF REALIZATION

Example 1

Figure 1:
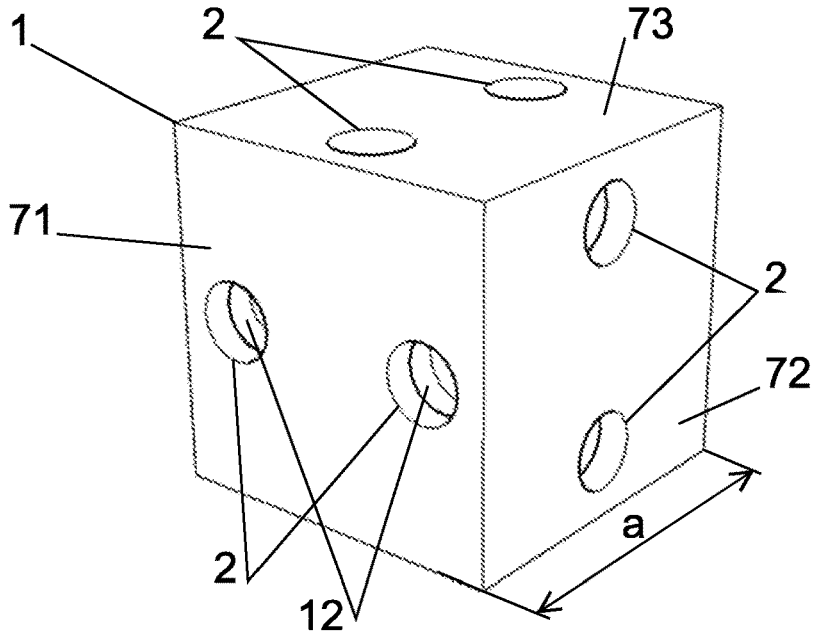
FIG. 1 spatially depicts a basic cube-shaped element with pairs of connecting openings visible on each side, whereby the circumferential grooves in the cavities of the connecting openings, designed for holding (locking) of the connecting pins, are partially visible, too.
Figure 2:
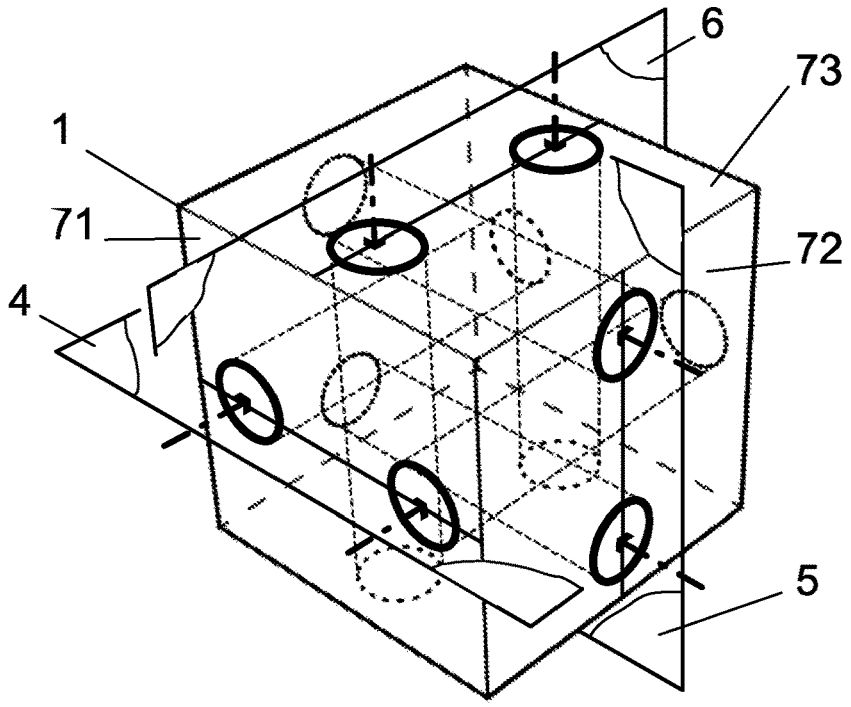
FIG. 2 is transparent view of six cavities of the connecting openings in the body of the basic element. For the purposes of clarity, the circumferential grooves are not depicted here.
Figure 3:
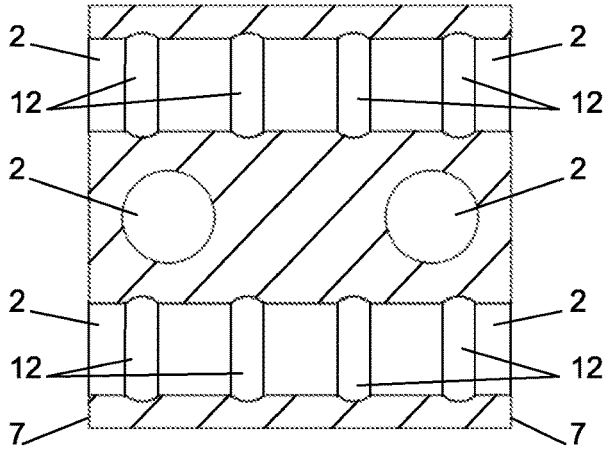
FIG. 3 is a cross-section of the body of the basic element in the first plane, where the circumferential grooves in the cavities of the connecting openings are depicted.
Figure 4:
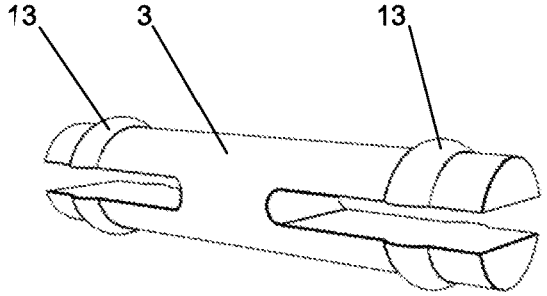
FIG. 4 is a spatial view of the connecting pin in the realization where there are two flexible segments on both edges of the connecting pin.
Figure 5:
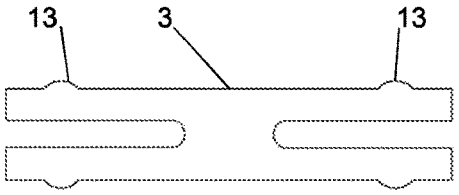
FIG. 5 is a cross-section of the connecting element in the central plane which is perpendicular onto the plane of the gap between the flexible segments.
Figure 6:
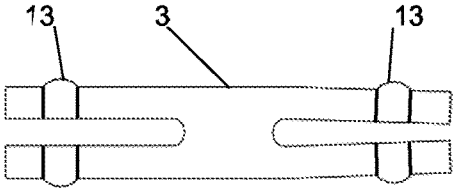
FIG. 6 depicts the deformation of the flexible elements during the insertion of the connecting element into the cavity of the connecting opening.
Figure 7:
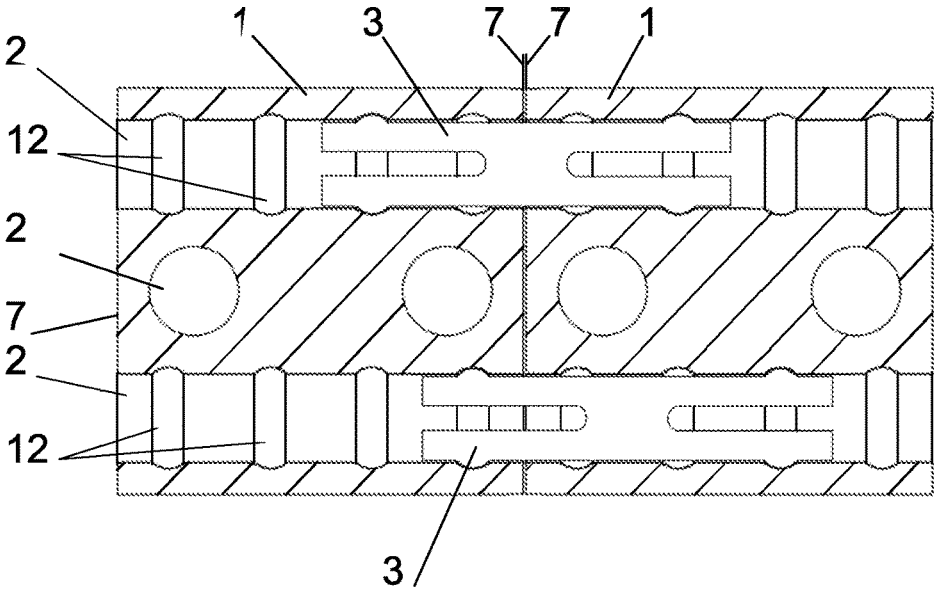
FIG. 7 is a cross-section of two basic elements connected by two connecting pins whereby the different depth of the insertion of the connecting pins is depicted.
Figure 8:
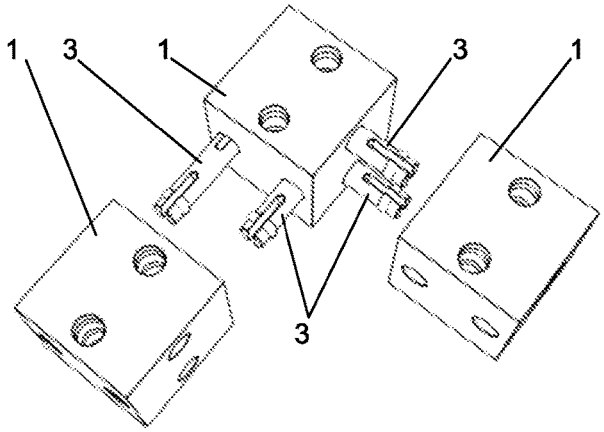
FIG. 8 is a spatial view of the connection of three basic cube-shaped elements with into a corner position. One connecting pin is depicted in the partially inserted state whereby three pins are inserted into half of the depth of the insertion in a single basic element.
Figure 9:
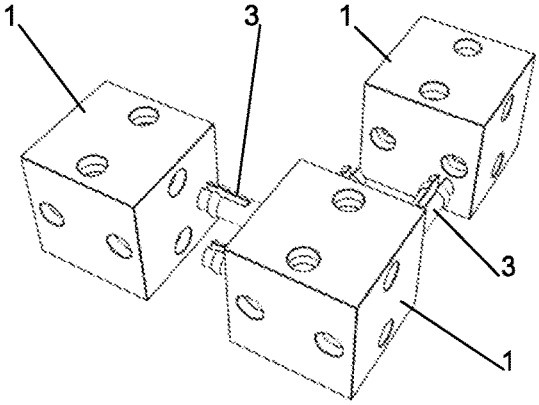
FIG. 9 depicts identical position of the same three basic elements in the spatial view from another direction, different than in FIG. 8.
Figure 10:
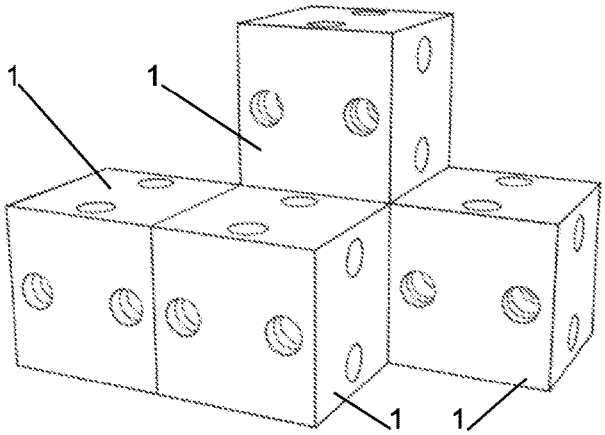
FIG. 10 is a three-dimensional view of the possibilities of connection of basic elements.
Figure 11:
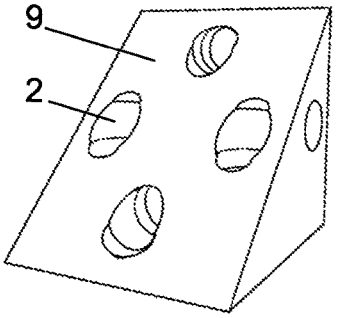
FIG. 11 depicts a sloped surface of the derived element, where the remnants of the cavities of the connecting openings after the cutting through the plane, which runs through diagonal of the one side of the basic element from which the derived element is derived, are visible.
Figure 12:
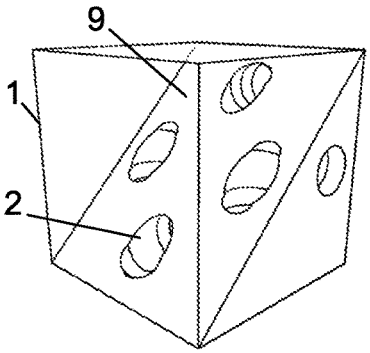
FIG. 12 depicts the element of FIG. 11 before cutting the basic cube shaped element.
Figure 13:
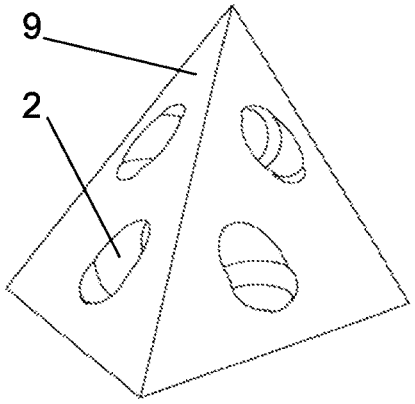
FIG. 13 depicts a derived element by two cuts through the basic cube-shaped element.
Figure 14:
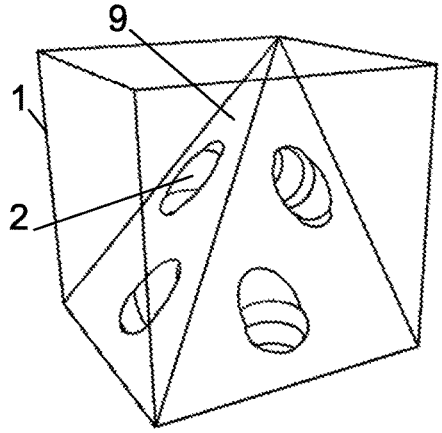
FIG. 14 depicts two sloped surfaces of the derived element, where the remnants of the cavities of the connecting openings after the cutting through the planes, which run through diagonals of the two neighboring sides of the basic element from which the derived element is derived, are visible.
Figure 15:
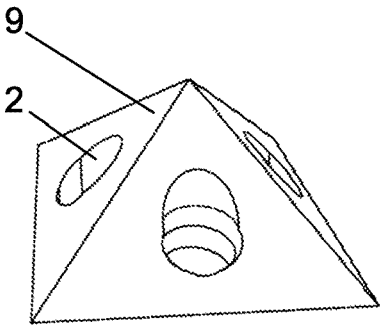
FIG. 15 depicts a derived element produced by four cuts through the basic cube-shaped element.
Figure 16:
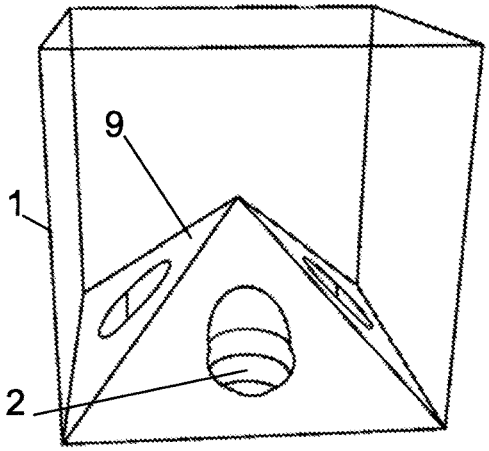
FIG. 16 depicts four sloped surfaces of the derived element, where the remnants of the cavities of the connecting openings after the cutting through the planes are visible, whereby these cuts turn the basic element into derived pyramid-shaped element.

In this example according to FIGS. 1 to 10 the basic element 1 has a shape of the cube with the dimension of the wall q. The body of the basic element 1 is made from plastics. On each wall (side) 7 there is a pair of connecting openings 2 which are placed side by side to each other in such a way that the center of the line connecting their axes is in the center of the wall 7, that is, the connecting openings 2 are symmetrical through the middle of the wall 7 of the basic element 1. On the first wall 71 there is a pair of connecting openings 2 arranged in such a way that the axes of the connecting openings 2 are in the first plane 4 the connecting openings 2 of the second wall 72 have axes in the second plane 5 and the connecting openings 2 in the third wall 73 have axes in the third plane 6. The first plane 4, the second plane 5 and the third plane are mutually perpendicular and they intersect in the center of the body of the cube that is the basic element 1. At the same time the diameter of all connecting openings 2 is the same. The mutual distance of the axes of the connecting openings 2 on the single wall 7 is larger than the diameter of the connecting openings 2 and this distance is the same on each wall 7. If the mutual distance of the axes of the connecting openings 2 on the single wall 7 were the same as the diameter of the connecting openings 2, the connecting pins inserted in these connecting openings 2 would touch each other, which would not be necessarily undesirable, or such a dimensional arrangement would cause complications during the production of the body of the basic element 1.

The pair of connecting openings on the individual walls 71, 72, 73 are placed in the middle (central) line of the respective wall 7, where this middle line is parallel with the edge of the cube and, at the same time, the pairs are rotated mutually between the walls 71, 72, 73 in such a way that the cavities of the connecting openings 2 in the central zone of the basic element 1 are mutually avoided without mutual interference. The cavities of all connecting elements 2 run continuously through whole body of the basic element from one side (wall) 7 to the opposite side (wall) 7.

The cavities of the connecting openings 2 have two circumferential grooves 12 which are in the distance of ⅛, ⅜, ⅝ and ⅞ of the length of the cavity, that is, dimension a.

A connecting pin 3 falls into the connecting openings 2, whereby the pin 3 in this example is produced from the flexible plastics and its length is the same as the dimension of the wall (side) 7-*a*. The connecting pin 3 in this example has a circular outer cross-section corresponding to the circular cross-section of the connecting openings 2; the diameter of the connecting pin 3 is diminished as opposed to the diameter of the connecting openings 2 by the gap which ensures an easy insertion of the connecting pin 3 into the connecting opening 2. Both ends of the connecting pins 3 are ended by two segments which run from the full circular cross-section of the material in the center of the connecting pin 3. The gap between the segments and the flexibility of the used material allows for the pressing of the segments towards each other. The transversal cross-section of each segment is a cut out of the circle which is less than semi-circle. On all segments a protrusion 13 is produced in the distance of ⅛ from the dimension a from the edge, whereby the protrusion 13 is designed by its shape and size in such a way that it falls into the circumferential groove 12 in the cavities of the connecting openings 2. The gap between the two segments is on each end at least as large as the difference between the diameter of the connecting openings 2 and the diameter of the connecting pin 3 at the point of the protrusions 13 in the unpressed state. The gap thus allows for flexible pressing of the protrusions 13 to the diameter of the connecting opening 2 without damage. At the same time the size of the gap determines the maximum allowed deformation of the segment in such a way that the segment is not broken.

As depicted on the FIGS. 7 to 10 the connecting pin 3 connects the neighboring basic elements 1, whereby the protrusions 13 locked in the circumferential grooves 12 create a relatively solid mechanical bond of the joint. The connecting pins 3 can be inserted into a basic element 1 from any direction, irrespective of the connecting pins 3 already inserted from other directions.

The building toy allows one to construe various spatial structures; the surface of the finished structure is smooth without the connecting protrusions.

The basic element 1 in this example is produced from solid material, for example by injection molding in the mold with the sliders or by 3D printing. In this example the technology of the production of the solid material of the cube is chosen—taking into account the relatively small dimension q compared to the diameter of the connecting openings 2. In such case the thickness of the material in individual walls 71, 72, 73 of the body is relatively even.

Example 2

In this example the basic element 1 with the geometry according to the previous example is hollow, whereby the cavities of the connecting openings are delimited by the pipes running from one side (wall) 7 to the opposite side (wall) 7. The body of the basic element 1 is welded by ultrasound from three components. Each component has two mutually perpendicular sides (walls) 7. From one side (wall) 7 run two pipes which form cavities of both connecting openings 2. The second side (wall) 7 has only two connecting openings 2 in the wall 7 which are designed for connection with two ends of the two pipes of the other component. The welding of three components produces a cube of the basic element 1, whereby the space between the pipes in the body is empty, matterless.

Example 3

Figure 17:
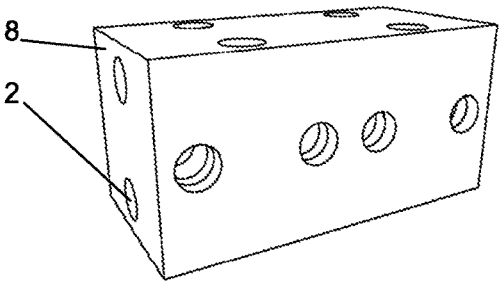
FIG. 17 depict a multiple element which results, from the merger of two basic cube-shaped elements.
Figure 18:
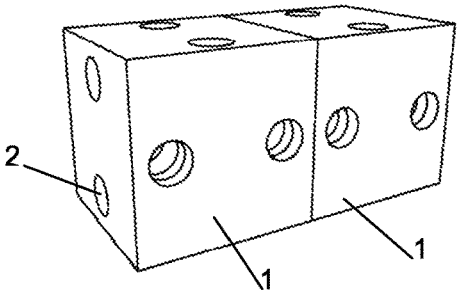
FIG. 18 depicts two basic cube-shaped elements aligned one to the other in the direct position.

In this example the building toy has—aside from the components according to examples 1 and 2—the multiple element 8, too, depicted on the FIGS. 17 and 18. The multiple element 8 in this example is made by combination of two basic elements 1 placed side by side in such a way that the connecting elements 2 are transitory through the whole body of the multiple element 8. The connecting openings 2 are placed in the same position as is the case in basic elements 1.

The details of the connecting openings 2 and connecting pins 3 are identical as in the previous examples.

Example 4

The derived elements 9 according to FIGS. 11 to 16 are produced by supposed cutting of the body of the basic cube-shaped element 1. Through various cut surfaces a shape of the triangular prism—or triangular pyramid—was produced, whereby the remnants of the cavities of the connecting openings 2 with the circumferential grooves 12 remain in the body of the derived element 9.

Example 5

Figure 19:
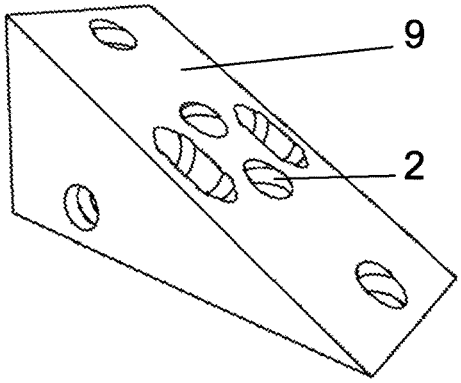
FIG. 19 depicts the derived element which results from the cut through one plane of the multiple elements produced by merger of two basic cube-shaped elements.
Figure 20:
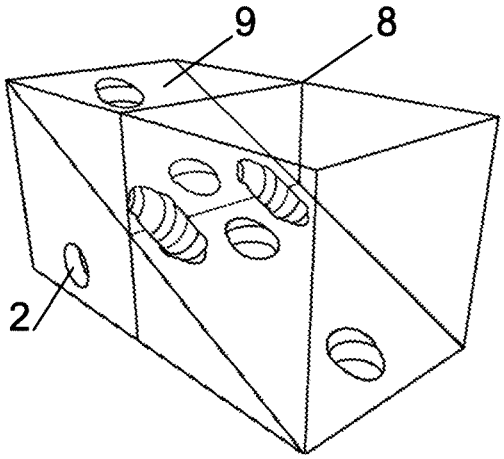
FIG. 20 depicts the derived element of FIG. 19 before cutting.
Figure 21:
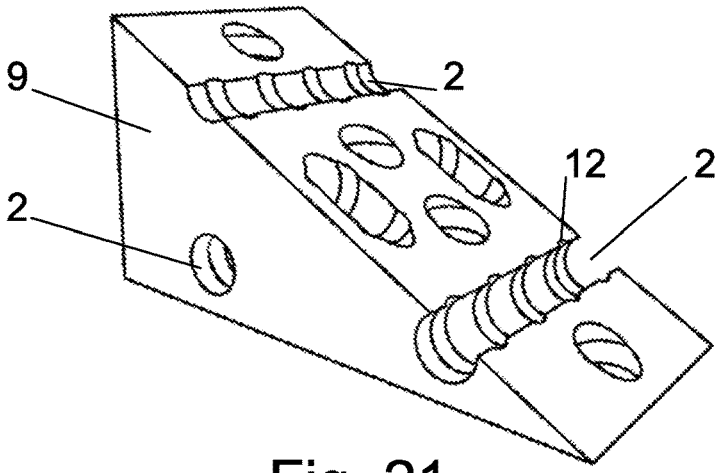
FIG. 21 depicts a realization where the remnants of the two cavities of the connecting openings remain, whereby the connecting elements are cut alongside the axis by the dividing plane.
Figure 22:
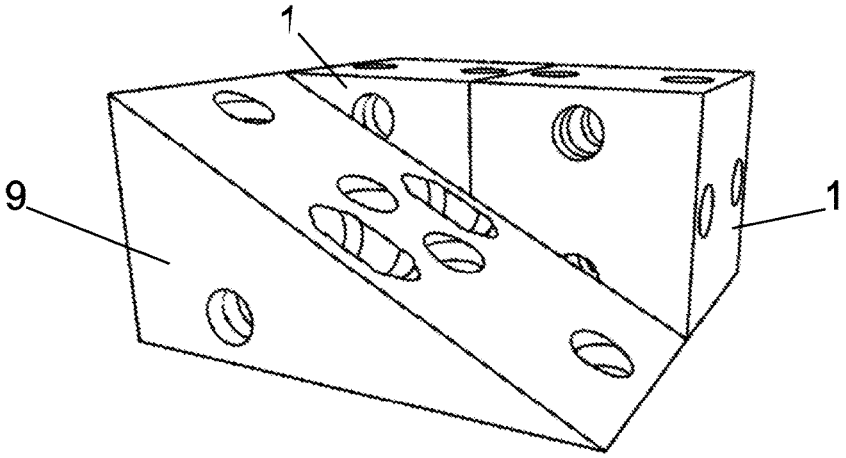
FIG. 22 depicts a position of the connection of the derived element from the FIG. 19 and then—for the purposes of comparison.
Figure 23:
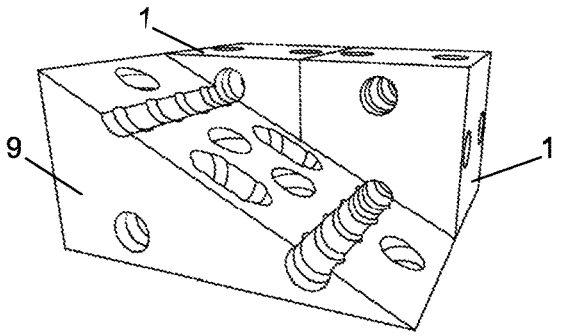
FIG. 23 depicts a position of the connection of the derived element according to FIG. 20.

Derived elements 9 according to FIGS. 19 and 23 are produced by supposed cutting of the body of the multiple element 8, which is produced by merger of two basic cube-shaped elements 1. In one realization (FIG. 21) the remnants of both cavities of the connecting openings 2 are maintained, whereby these are cut by the dissection plane alongside their axis. In another realization (FIGS. 19 and 20) these connecting openings 2 are left out and the surface of the dissection plane is smoother and more aesthetically pleasing.

Example 6

Figure 24:
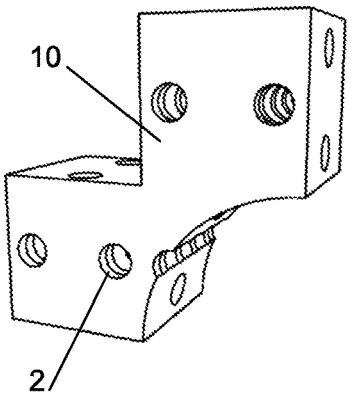
FIG. 24 depicts a combined element which includes a multiple element combined with the derived element.
Figure 25:
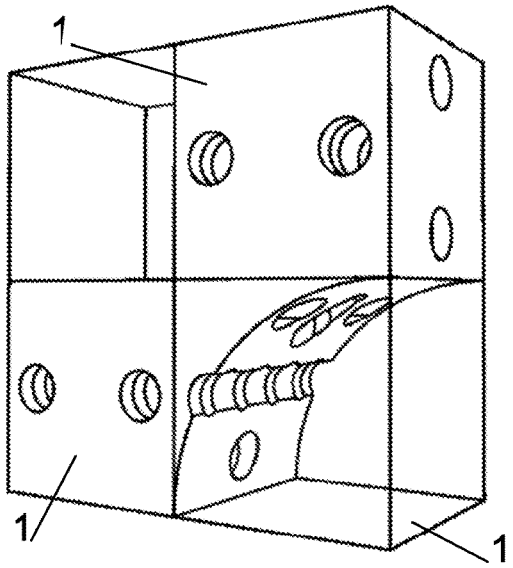
FIG. 25 depicts three basic cube-shaped elements composed into a corner position whereby a cut with the cylindrical surface is led through the basic element in one corner.
Figure 26:
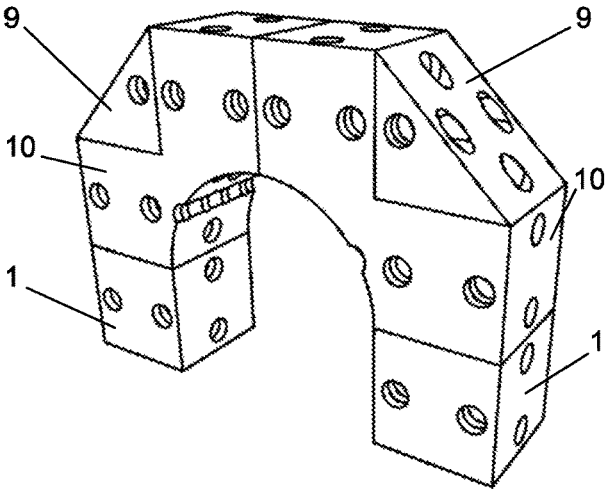
FIG. 26 is an example of the use of the combined element from FIG. 24 for the purposes of a construction of an arc together with basic and derived elements.
Figure 27:
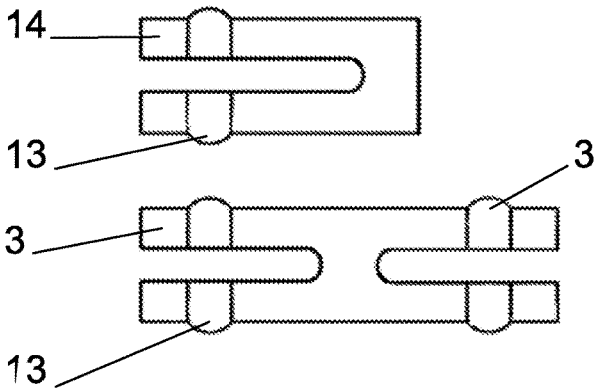
FIG. 27 is a view of the blinding pin in comparison with the shortened pin.
Figure 28:
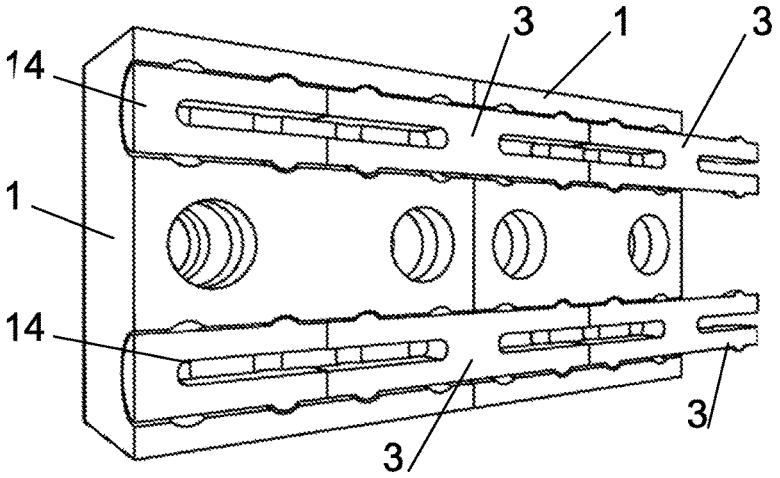
FIG. 28 depicts an example of the use of the blinding pin in the spatial transparent view.
Figure 29:
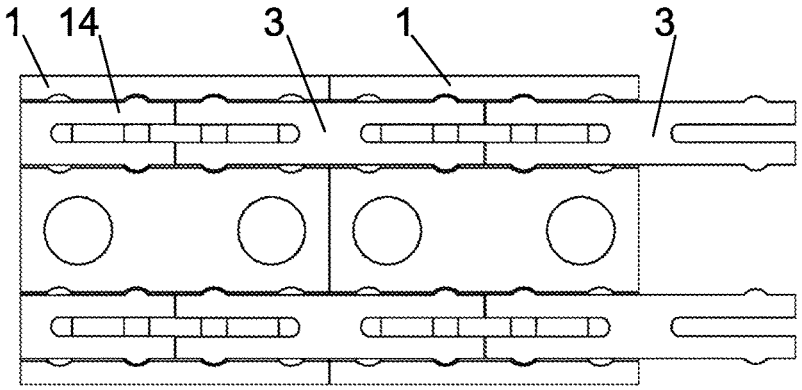
FIG. 29 depicts a side view of FIG. 28.
Figure 30:
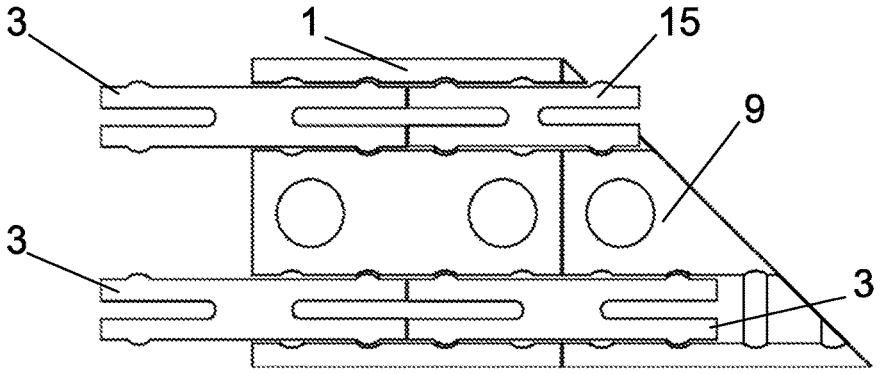
FIG. 30 depicts a shortened connecting pin where it is inserted into the basic and derived element.
Figure 31:
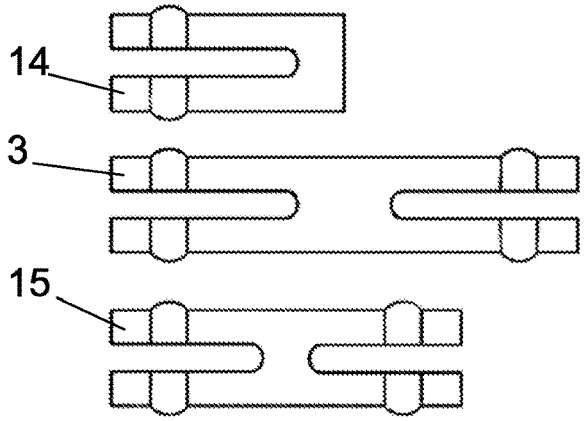
FIG. 31 is a view of the blinding pin, connecting pin and shortened pin for the purposes of comparison.

A building toy according to this example and FIGS. 24 to 26 includes a combined element 10 which is produced by merger of basic element 1 and derived element 9. This combined element 10 allows one to easily create arcs.

Example 7

The building toy in this example has, aside from the connecting pins 3 with the length a, a shortened pin 15 and blinding pin 14, too, as depicted on the FIGS. 27 to 31. These pins are compatible by the dimensions and shape with other elements of the building toy pursuant to the previous examples. The shortened pin 15 has a length which is ¾ a. The blinding pin 14 has a length which is ½ a. The blinding pin 14 has two flexible segments with the protrusions 13 on one end, whereby the other end is formed by a flat front.

Example 8

Figure 32:
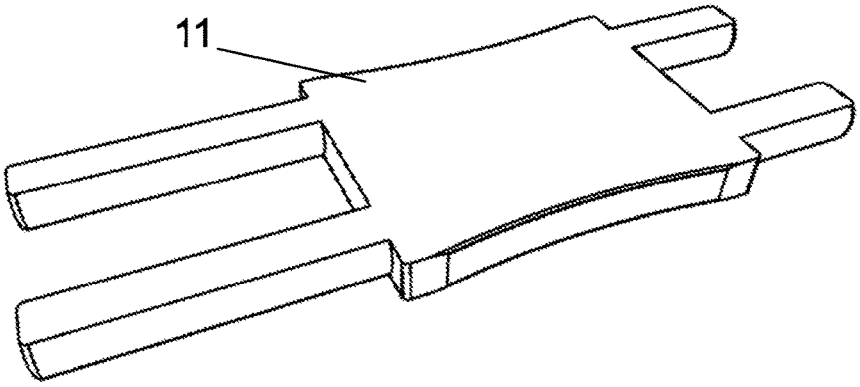
FIG. 32 is a spatial view of the tool with two pairs of spikes.
Figure 33:
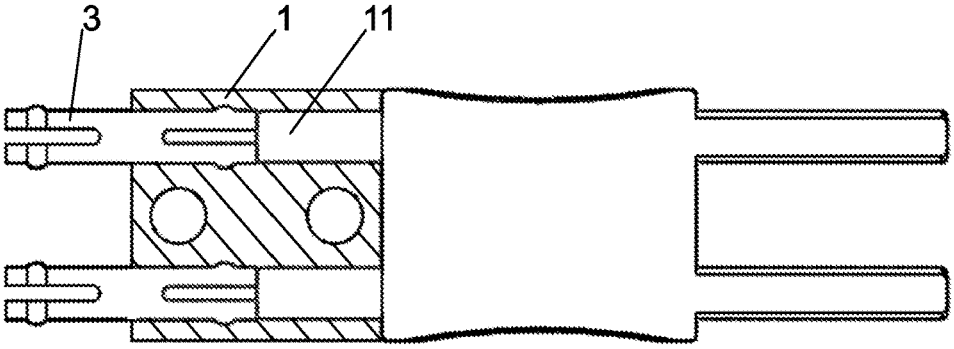
FIG. 33, the shorter pair of the spikes is inserted into the basic element in such a way that the connecting pins are pushed out by the spikes which are in the depth that is half the dimension of the basic element.

A tool 11 pursuant to FIGS. 32 to 33 is composed of a flat handle and two pairs of spikes. One pair of spikes runs from the flat handle on one side, whereby the spikes are ½ a long, and on the other side there are two spikes with a length a. As depicted on the FIG. 33, the pitch (distance) between the spikes corresponds to the pitch (distance) between the connecting openings 2 on the wall 7. By pushing the spikes of the tool 11 into the connecting openings 2 the connecting pins 3, are pushed into the half the length of the cavity. The other side of the tool 11 pushes the connecting pins 3 out of the cavities of the connecting openings 2 of the basic elements 1. The tool 11 is preferably used during the assembly as well as disassembly.

INDUSTRIAL APPLICABILITY

The industrial applicability is obvious. Pursuant to the invention it is possible to industrially and repeatedly produce and use building toys with at least one basic element and at least one connecting pin, preferably with multiple and/or derived and/or combined element and especially preferably with a tool for insertion and pushing out of the connecting pins.

LIST OF SYMBOLS

1—basic element
2—connecting opening
3—connecting pin
4—first plane
5—second plane
6—third plane
7—wall
  71—first wall
  72—second wall
  73—third wall
8—multiple element
9—derived element
10—combined element
11—tool
12—circumferential groove
13—protrusion
14—blinding pin
15—shortened pin
a—dimension of a wall

The invention claimed is:

1. A building toy comprising:

at least one basic element (1), at least one independent connecting pin (3), wherein the basic element (1) has a body having at least three adjacent walls (7), each one of the walls (7) is perpendicular to the corresponding adjacent walls forming an internal cavity on the body, each one of the walls (7) includes a pair of connecting openings (2) located side by side to each other and wherein of a line connecting axes of the pair of connecting openings (2) is located in a center of the wall (7) being symmetrical through the middle of the wall (7), wherein each one of the pair of connecting openings (2) on each wall are located on a different plane, wherein each one of the planes are perpendicular to each other and intersect in a center of the basic element (1), wherein each one of the connecting openings (2) are placed in a middle central line of the corresponding wall and the middle line is parallel with an edge of the basic element, wherein each one of the connecting openings (2) run through the internal cavity of the body from one of the walls to the opposite wall, forming a transitory cavity, wherein each one of the transitory cavities of the connecting openings (2) is mutually avoided without mutual interference with regards to the other transitory cavities, a connecting pin (3) inserted to each one of the connecting openings, each one of the connecting pins (3) connects the basic element (1) with a second basic element of the building toy, and wherein a profile of each one of the connecting openings (2) is independent and without an intersection with the profile of the other connecting openings (2) in the body.

2. The building toy according to the claim 1, wherein the connecting openings (2) have a circular cross-section and an identical diameter.

3. The building toy according to the claim 1, wherein adjacent edges of the connecting openings (2) on each wall are distanced from each other at least at a length corresponding to a diameter of the connecting openings (2).

4. The building toy according to claim 1, wherein the pair of connecting openings includes:

a first pair of the connecting openings (2) is on a first wall (71) of the basic element (1); the axes of both connecting openings (2) in the first pair lie in a first plane (4), which is perpendicular onto the first wall (71), and the first plane (4) runs through the middle of the first wall (71);

a second pair of the connecting openings (2) is on a second wall (72) of the basic element (1); the axes of both connecting openings (2) in the second pair lie in a second plane (5), which is perpendicular onto the second wall (72), and the second plane (5) runs through the middle of the second wall (72);

the second plane (5) is perpendicular onto the first plane (4), and, at the same time, the second plane (5) intersects the first plane (4) in a line, which is a symmetry axis of the first pair of the connecting openings (2);

a third pair of the connecting openings (2) is on a third wall (73) of the basic element (1); the axes of both connecting openings (2) in the third pair lie in a third plane (6) which is perpendicular onto the third wall (73) and the third plane (6) runs through the middle of the third wall (73);

the third plane (6) is perpendicular onto the first plane (4), and, at the same time, onto the second plane (5), and, at the same time, the third plane (6) intersects the second plane (5) in the line, which is the symmetry axis of the second pair of the connecting openings (2).

5. The building toy according to claim 4, wherein the basic element (1) has an outer shape of a cube.

6. The building toy according to claim 5, wherein the basic element (1) has six cavities of the connecting openings (2), which in parallel pairs run through the first, second and third mutually perpendicular planes (4, 5, 6), whereby each cavity runs from one wall (7) of the cube to the opposite wall (7) of the cube and all the connecting elements (2) are identical.

7. The building toy according to claim 1, further including at least one multiple element (8) which is formed by a merger of two or more basic elements (1) into a single body, whereby the connecting elements (2) are in the same position as in the case of the basic elements (1) which were merged, and all the connecting elements (2) are transitory.

8. The building toy according to claim 7, wherein the basic element (1), and/or a multiple element (8), and/or a derived element (9) is made of plastics, wood, metal, glass, or combination thereof.

9. The building toy according to claim 1, further including at least one derived element (9) formed by cutting a section of the basic element (1).

10. The building toy according to claim 9, further including at least one combined element (10) whose body is a merger of the basic element (1) and the derived element (9).

11. The building toy according to claim 1, wherein the connecting pin's (3) length is equal to a dimension (a) of the wall (7) of the basic element (1) or its length is a whole number multiple of the dimension (a) of the wall (7) of the basic element (1).

12. The building toy according to claim 1, further including a shortened connecting pin (15) whose length is a half or ¾ of the dimension (a) of the wall (7) of the basic element (1).

13. The building toy according to claim 12, wherein the connecting pin (3) and/or the shortened connecting pin (15) have both ends branching into two or more flexible segments, whereby there is a gap between the segments, and there is an outwardly oriented protrusion (13) on the segments, and in the cavity of the connecting opening (2) there is a circumferential groove (12) which is adjusted for the protrusion (13) to fall into, or lock into, this groove (12) by its shape, dimension and position.

14. The building toy according to claim 13, wherein the first circumferential groove (12) is in ⅛ of a length of the cavity of the basic element (1); second is in ⅜ of the length of the cavity of the basic element (1); third is in ⅝ of the length of the cavity of the basic element (1); and fourth is in ⅞ of the length of the cavity of the basic element (1).

15. The building toy according to claim 1, further including a blinding pin (14) having a first end including flexible segments with a protrusion (13) and a second end including a flat front.

16. The building toy according to claim 1, wherein the connecting pin (3), a shortened pin (15), and a blinding pin (14) are made from plastics, metal, or combination thereof.

17. The building toy according to claim 1, wherein the connecting pin (3), a shortened pin (15), or a blinding pin (14) have a color equal as a color of the basic element (1), a multiple element (8), or a derived element (9).

18. The building toy according to claim 1, further including a tool (11) having at least one spike with a diameter corresponding to a diameter of the connecting openings (2).

19. The building toy according to the claim 18, wherein the tool (11) has a handle from which stem two parallel spikes, whereby a pitch of the spikes corresponds to a pitch of the connecting openings (2) on the wall (7).

20. The building toy according to the claim 18, further including a handle on the tool (11) having a first side including two spikes having a length that is half of a length (a) of the cavity of the connecting opening (2) of the basic element (1) and a second side includes two spikes with the length that is the same as the length (a) of the cavity of the connecting opening (2) of the basic element (1).

* * * * *